US010944161B2

(12) United States Patent
Kim et al.

(10) Patent No.: US 10,944,161 B2
(45) Date of Patent: Mar. 9, 2021

(54) FILM-TYPE MICROSTRIP PATCH ANTENNA

(71) Applicant: DONGWOO FINE-CHEM CO., LTD., Iksan-si (KR)

(72) Inventors: Jong Min Kim, Pyeongtaek-si (KR); Jae Hyun Lee, Uiwang-si (KR); Dong Pil Park, Incheon (KR)

(73) Assignee: DONGWOO FINE-CHEM CO., LTD., Iksan-Si (KR)

( * ) Notice: Subject to any disclaimer, the term of this patent is extended or adjusted under 35 U.S.C. 154(b) by 0 days.

(21) Appl. No.: 16/489,387

(22) PCT Filed: Nov. 20, 2017

(86) PCT No.: PCT/KR2017/013176
§ 371 (c)(1),
(2) Date: Aug. 28, 2019

(87) PCT Pub. No.: WO2018/159925
PCT Pub. Date: Sep. 7, 2018

(65) Prior Publication Data

US 2019/0386387 A1 Dec. 19, 2019

(30) Foreign Application Priority Data

Feb. 28, 2017 (KR) ..... 10-2017-0026381

(51) Int. Cl.
*H01Q 1/38* (2006.01)
*H01Q 1/24* (2006.01)
(Continued)

(52) U.S. Cl.
CPC ..... *H01Q 1/36* (2013.01); *H01Q 1/22* (2013.01); *H01Q 1/241* (2013.01); *H01Q 1/242* (2013.01);
(Continued)

(58) Field of Classification Search
CPC ..... H01Q 1/38; H01Q 21/065; H01Q 9/0407; H01Q 1/243; H01Q 13/08; H01Q 9/065;
(Continued)

(56) References Cited

U.S. PATENT DOCUMENTS 5,903,239 A * 5/1999 Takahashi ..... H01Q 1/2283 343/700 MS
6,255,995 B1 * 7/2001 Asano ..... H01Q 1/007 343/700 MS
(Continued)

FOREIGN PATENT DOCUMENTS

CN 1639914 A 7/2005
CN 105742797 A 7/2013
(Continued)

OTHER PUBLICATIONS

First Office Action from corresponding Chinese Patent Appln. No. 201780087491 dated Apr. 1, 2020, and its English translation.

*Primary Examiner* — Vibol Tan
(74) *Attorney, Agent, or Firm* — DLA Piper LLP (US)

(57) ABSTRACT

The present invention relates to a film-type microstrip patch antenna. The present invention comprises: a base film; a microstrip transmission line part formed on one surface of the base film; a radiation patch part formed on the one surface of the base film so as to be electrically connected to the microstrip transmission line part; and a ground part formed on the other surface of the base film. The present invention can be implemented in a screen display area of a display device, be applied to a high-frequency band for 3G to 5G mobile communication, and prevent the moire phenomenon caused by components of an antenna, thereby improving the optical characteristics of the display device mounted with the antenna.

12 Claims, 3 Drawing Sheets

(51) Int. Cl.
*H01Q 1/36* (2006.01)
*H01Q 1/22* (2006.01)
*H01Q 9/04* (2006.01)

(52) U.S. Cl.
CPC ..... *H01Q 1/243* (2013.01); *H01Q 1/38* (2013.01); *H01Q 9/0407* (2013.01)

(58) Field of Classification Search
CPC ..... H01Q 9/0485; H01L 21/4857; H01L 2223/6627; H01L 2223/6677; H01L 23/49822; H05K 1/0393
See application file for complete search history.

(56) References Cited

U.S. PATENT DOCUMENTS 8,830,133 B2 * 9/2014 Weily ..... H01Q 19/10 343/770
9,276,305 B2 * 3/2016 Keller ..... H01Q 1/273
9,391,428 B2 * 7/2016 Koyama ..... H01S 5/34
2009/0169916 A1 * 7/2009 Lee ..... H05K 3/244 428/620
2011/0298665 A1 * 12/2011 Wu ..... H01Q 1/088 343/700 MS
2013/0234304 A1 * 9/2013 Tamaki ..... H01L 23/66 257/659
2017/0141472 A1 * 5/2017 Park ..... H01Q 1/36
2019/0069788 A1 * 3/2019 Coleman ..... A61B 5/0448

FOREIGN PATENT DOCUMENTS

CN 204103040 U 1/2015
CN 105190991 A 12/2015
JP 2009-177002 A 8/2009
JP 2014-207654 A 10/2014
KR 2000-0019433 A 4/2000
KR 100309416 B1 11/2001
KR 100965395 B1 6/2010

* cited by examiner

FILM-TYPE MICROSTRIP PATCH ANTENNA

TECHNICAL FIELD

This invention relates to a film-type microstrip patch antenna. More specifically, the present invention relates to a film-type microstrip patch antenna that may be implemented on a screen display area of a display device and is applicable for a high-frequency band for 3G to 5G mobile communication.

BACKGROUND ART

Generally, a microstrip patch antenna has the advantages of a small size, a light weight, easy fabrication, uniform signal radiation characteristics, and low cost. Due to these advantages, the microstrip patch antenna is applied to various communication devices, and is particularly suitable as an antenna for 3G to 5G mobile communication.

Meanwhile, as a display provided in a communication device is enlarged and a bezel area is reduced accordingly, it is necessary to mount a microstrip patch antenna on a screen display area of the display. However, since a conventional microstrip patch antenna is formed on a printed circuit board, there is a problem that components of the antenna on the screen display area of the display are unnecessarily visible to the user.

Further, there are problems that a signal loss in a microstrip transmission line is high, and when an error occurs in impedance matching, the performance of the antenna is greatly deteriorated in a high-frequency environment such as 5G.

PRIOR-ART DOCUMENTS

Patent Document (Patent Document 1) Korean Patent Application Publication No. 2000-0019433 (Title: Transmission and reception integrated microstrip patch antenna)

SUMMARY OF INVENTION

Technical Problem

This invention is directed to providing a film-type microstrip patch antenna capable of being implemented in a screen display area of a display device by preventing components of an antenna from being unnecessarily visible to a user.

This invention is also directed to providing a film-type microstrip patch antenna capable of securing stable performance in a high-frequency environment such as 5G, in which a signal loss in a microstrip transmission line is high, through precise impedance matching.

This invention is also directed to providing a film-type microstrip patch antenna capable of being implemented in a screen display area of a display device and applied for a high-frequency band for 3G to 5G mobile communication.

Solution to Problem

One aspect of this invention provides a film-type microstrip patch antenna including a base film, a microstrip transmission line unit formed on one surface of the base film, a radiating patch unit formed on the one surface of the base film to be electrically connected to the microstrip transmission line unit, and a ground unit formed on the other surface of the base film.

Another aspect of this invention provides a film-type microstrip patch antenna including a base film, a ground unit formed on the base film, an Insulating layer formed on the ground unit, a microstrip transmission line unit formed on the Insulating layer, and a radiating patch unit formed on the Insulating layer to be electrically connected to the microstrip transmission line unit.

In the film-type microstrip patch antenna according to both aspects of this invention, the base film may be implemented in the form of a dielectric film.

In the film-type microstrip patch antenna according to both aspects of this invention, a resistance of the microstrip transmission line unit may be 70Ω or more and 230Ω or less.

In the film-type microstrip patch antenna according to both aspects of this invention, a length of the microstrip transmission line unit may satisfy Equation 1 below $$L=\lambda/2 \qquad \text{[Equation 1]}$$

wherein L is the length of the microstrip transmission line unit, and λ may be a wavelength of a signal.

In the film-type microstrip patch antenna according to both aspects of this invention, a reflection coefficient S21 may be −10 dB or less.

In the film-type microstrip patch antenna according to both aspects of this invention, a transmission coefficient S21 may be −5 dB or more.

In the film-type microstrip patch antenna according to both aspects of this invention, at least one of the microstrip transmission line unit, the radiating patch unit, and the ground unit may include at least one of copper (Cu), aluminum (Al), silver (Ag), nickel (Ni), chromium (Cr), cobalt (Co), molybdenum (Mo), titanium (Ti), palladium (Pd), or alloys thereof.

In the film-type microstrip patch antenna according to both aspects of this invention, at least one of the microstrip transmission line unit, the radiating patch unit, and the ground unit may have a mesh structure.

In the film-type microstrip patch antenna according to both aspects of this invention, at least one of the microstrip transmission line unit, the radiating patch unit, and the ground unit may have a single-layer or multi-layer structure.

In the film-type microstrip patch antenna according to one aspect of this invention, a plurality of unit antennas each including the base film, the microstrip transmission line unit, the radiating patch unit, and the ground unit may be arranged.

In the film-type microstrip patch antenna according to another aspect of this invention, a plurality of unit antennas each including the base film, the Insulating layer, the microstrip transmission line unit, the radiating patch unit, and the ground unit may be arranged.

Advantageous Effects of Invention

According to this invention, there is provided a film-type microstrip patch antenna capable of being implemented in a screen display area of a display device by preventing components of an antenna from being unnecessarily visible to a user.

In addition, there is provided a film-type microstrip patch antenna capable of securing stable performance in a high-frequency environment such as 5G, in which a signal loss in a microstrip transmission line is great, through precise impedance matching.

In addition, there is provided a film-type microstrip patch antenna capable of being implemented in a screen display area of a display device and applied for a high-frequency band for 3G to 5G mobile communication.

DETAILED DESCRIPTION OF EMBODIMENTS

Figure 1:
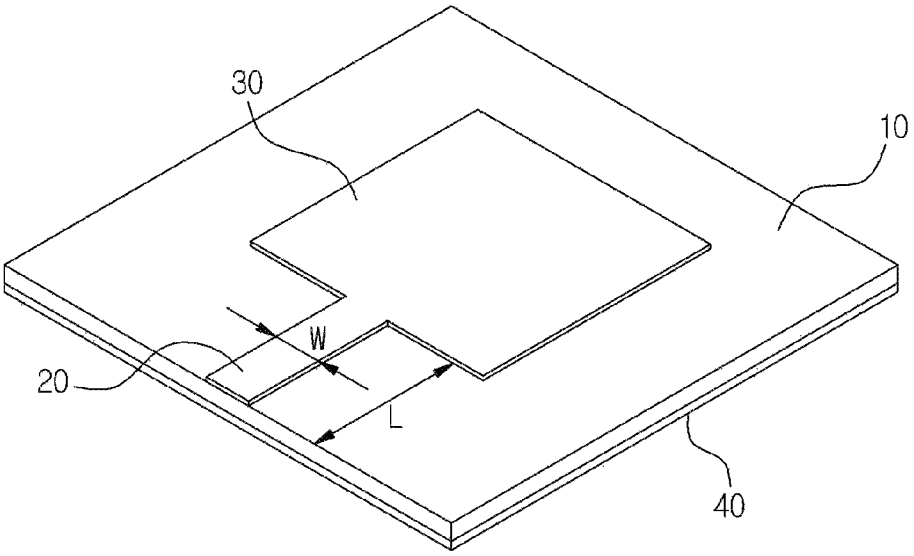
FIG. 1 is a perspective view of a film-type microstrip patch antenna according to a first embodiment of this invention.

As specific structural or functional descriptions for the embodiments according to the concept of the invention disclosed herein are merely exemplified for purposes of describing the embodiments according to the concept of the invention, the embodiments according to the concept of the invention may be embodied in various forms and are not limited to the embodiments described herein.

While the embodiments of this invention are susceptible to various modifications and alternative forms, specific embodiments thereof are shown by way of example in the drawings and will herein be described in detail. It should be understood, however, that it is not intended to limit the embodiments according to the concepts of this invention to the particular forms disclosed, and the invention includes all modifications, equivalents, or alternatives falling within the spirit and scope of the invention.

While terms such as "first," or "second," etc., may be used to describe various components, such components should not be limited to the above terms. The terms may be used only for the purpose of distinguishing one element from another, for example, without departing from the scope of the right according to the concept of this invention, the first component may be referred to as a second component, and similarly, the second component may also be referred to as a first component.

When it is described that one component is "connected" or "linked" to another component, it should be understood that the one component may be directly connected or joined to the other component, but another component may be present therebetween. On the other hand, when an element is referred to as being "directly connected" or "directly linked" to another element, it should be understood that there are no other elements therebetween. Other expressions that describe the relationship between components, such as "between" and "directly between" or "adjacent to" and "directly adjacent to" should be interpreted in a similar manner The terms used herein are for the purpose of describing only specific embodiments and are not intended to limit this invention. The singular expressions include plural expressions unless the context clearly dictates otherwise. In this specification, the terms "comprises" or "having" and the like are used to specify that there are features, numbers, steps, operations, components, parts or combinations thereof described herein, but do not preclude the presence or addition of one or more other features, numbers, steps, operations, components, parts, or combinations thereof.

Unless otherwise defined, all terms used herein including technical or scientific terms have the same meanings as those generally understood by one of ordinary skill in the art. It should be further understood that terms, such as those defined in commonly used dictionaries, should be interpreted as having a meaning that is consistent with their meaning in the context of the relevant art and are not to be interpreted in an idealized or overly formal sense unless expressly so defined herein.

Hereinafter, exemplary embodiments of this invention will be described in detail with reference to the accompanying drawings.

Figure 2:
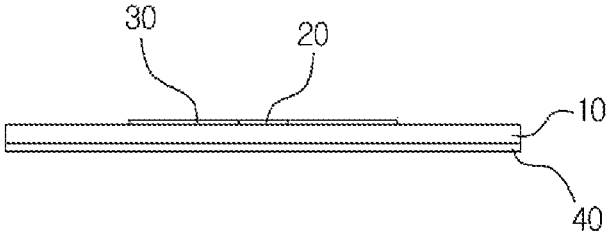
FIG. 2 is a cross-sectional view of the film-type microstrip patch antenna according to the first embodiment of this invention.

FIG. 1 is a perspective view of a film-type microstrip patch antenna according to a first embodiment of this invention, and FIG. 2 is a cross-sectional view of the film-type microstrip patch antenna according to the first embodiment of this invention.

Referring to FIGS. 1 and 2, the film-type microstrip patch antenna according to the first embodiment of this invention includes a base film 10, a microstrip transmission line unit 20, a radiating patch unit 30, and a ground unit 40.

A microstrip patch antenna has the advantages of a small size, a light weight, easy fabrication, uniform signal radiation characteristics, and low cost. According to these advantages, the microstrip patch antenna is applied to various communication devices, and is particularly suitable as an antenna for 3G to 5G mobile communication.

Meanwhile, as described in the process of describing the problems of the related art, since a display provided in the communication device is enlarged and a bezel area is reduced accordingly, it is necessary to mount the microstrip patch antenna on a screen display area of the display. However, since a conventional microstrip patch antenna is formed on a printed circuit board, there is a problem that components of the antenna are unnecessarily visible on the screen display area of the display.

However, the film-type microstrip patch antenna according to the first embodiment of this invention solves the problem, in which components of the antenna are unnecessarily visible, by replacing the printed circuit board by applying the base film 10.

For example, the base film 10 may be implemented in the form of a dielectric film, and more specifically, the base film 10 may be a film having a dielectric constant of 8 or less and may include polyvinyl alcohol (PVA), polyimide (PI), polyethylene terephthalate (PET), a cycloolefin polymer (COP), triacetyl cellulose (TAC), a low temperature co-fired ceramic (LTCC), and the like.

In addition, the base film 10 may be, for example, a transparent optical film or a polarizing plate.

As the transparent optical film, a film having excellent transparency, mechanical strength, and thermal stability may be used, and a specific example thereof includes a film made of thermoplastic resins such as polyester-based resins such as polyethylene terephthalate, polyethylene isophthalate, polyethylene naphthalate, and polybutylene terephthalate; cellulose-based resins such as diacetylcellulose and triacetylcellulose; polycarbonate-based resins; acrylic-based resins such as polymethyl (meth) acrylate and polyethyl (meth)

acrylate; styrene-based resins such as polystyrene and an acrylonitrile-styrene copolymer; polyolefin-based resins such as polyethylene, polypropylene, polyolefins having a cyclo or norbornene structure, and ethylene-propylene copolymers; vinyl chloride-based resins; amide-based resins such as nylon and aromatic polyamides; imide-based resins; polyether sulfone-based resins; sulfone-based resins; polyetheretherketone-based resins; polyphenylene sulfide-based resins; vinyl alcohol-based resins; vinylidene chloride-based resins; vinyl butyral-based resins; allylate-based resins; polyoxymethylene-based resins; and epoxy-based resins, and a film made of blends of the thermoplastic resins may also be used. Further, a film made of a thermosetting resin such as (meth) acrylic, urethane, acrylic urethane, epoxy, or silicone or a film made of an ultraviolet curable resin may be used. The thickness of such a transparent optical film may be suitably determined, but in general, it may be determined to be 1 to 500 μm in consideration of strength, workability such as handling properties, thin layer properties, and the like. Particularly, 1 to 300 μm is preferable, and 5 to 200 μm is more preferable.

The transparent optical film may contain one or more suitable additives. Examples of the additive may include an ultraviolet absorber, an antioxidant, a lubricant, a plasticizer, a releasing agent, an anti-coloring agent, a flame retardant, a nucleating agent, an antistatic agent, a pigment, and a coloring agent. The transparent optical film may have a structure including various functional layers such as a hard coating layer, an anti-reflection layer, and a gas barrier layer on one surface or both surfaces of the film, and the functional layer is not limited to those described above and may include various functional layers according to the application.

Further, the transparent optical film may be surface-treated as necessary. Examples of the surface treatment may include a dry treatment such as a plasma treatment, a corona treatment, and a primer treatment, and a chemical treatment such as an alkaline treatment including a saponification treatment.

Further, the transparent optical film may be an isotropic film, a retardation film, or a protective film.

In the case of the isotropic film, an in-plane retardation Ro ($Ro=[(nx-ny)\times d$, wherein nx and ny are principal refractive indexes in a film plane, and d is a film thickness) is 40 nm or less, and preferably, 15 nm or less, and a thickness direction retardation Rth ($Rth=[(nx+ny)/2-nz]\times d$, wherein nx and ny are principal refractive indexes in a film plane, nz is a refractive index in a film thickness direction, and d is a film thickness) is in a range of −90 nm to +75 nm, preferably, −80 nm to +60 nm, and more particularly, −70 nm to +45 nm.

The retardation film is a film manufactured by the method of uniaxial stretching, biaxial stretching, polymer coating, liquid crystal coating, and the like of a polymer film, and is generally used for improving and adjusting optical characteristics such as viewing angle compensation, color sense improvement, light leakage improvement, and color tone control of a display. The types of the retardation film include a wave plate such as a half-wave plate or quarter-wave plate, a positive C plate, a negative C plate, a positive A plate, a negative A plate, and a biaxial wave plate.

The protective film may be a film in which an adhesive layer is included on at least one surface of a film made of a polymer resin, or a self-adhesive film such as polypropylene, and may be used for protecting the surface of a touch sensor and improving processability.

Any known one which is used in the display panel may be used as the polarizing plate. Specifically, examples thereof may include those formed by providing a protective layer on at least one surface of a polarizer obtained by stretching a polyvinyl alcohol film and dyeing with iodine or a dichroic dye, those in which a liquid crystal is oriented to have the performance of a polarizer, and those manufactured by coating a transparent film with an orientation resin such as polyvinyl alcohol and stretching and dyeing the film, but this invention is not limited thereto.

The microstrip transmission line unit 20 is formed on one surface of the base film 10 and provides a path through which a signal is fed.

For example, in order to secure desired antenna performance in a high-frequency environment such as 5G in which a great signal loss occurs in the microstrip transmission line unit 20 which is a signal transmission path, impedance matching in the microstrip transmission line unit 20 is very important.

To this end, for example, resistance of the microstrip transmission line unit 20 may be 70Ω or more and 230Ω or less, a reflection coefficient S11 of the film-type microstrip patch antenna according to the first embodiment of this invention may be −10 dB or less, and a transmission coefficient S21 may be −5 dB or more.

The reflection coefficient S11 may be expressed as −20 log (reflected voltage/input voltage) as an equation, which means how much voltage is reflected when the input voltage is applied. For example, when the input voltage is equal to the reflected voltage, S11=0. In this case, since all the input voltage is reflected and returned, no signal is transmitted. That is, this case corresponds to the case in which the impedance matching fails. All comparative examples below are the cases in which S11 is high due to poor impedance matching.

The transmission coefficient S21 may be expressed as −20 log (received voltage/input voltage) as an equation, which means how much voltage is transmitted to a receiving unit when the input voltage is applied. For example, when the input voltage is equal to the received voltage, S21=0. Since this case means that 100% of the signal is transmitted from a transmitting unit to the receiving unit, it is the best condition. Likewise, while it is the best condition as S21 approaches 0, S21 in the case of comparative examples is low due to poor impedance matching.

Figure 6:
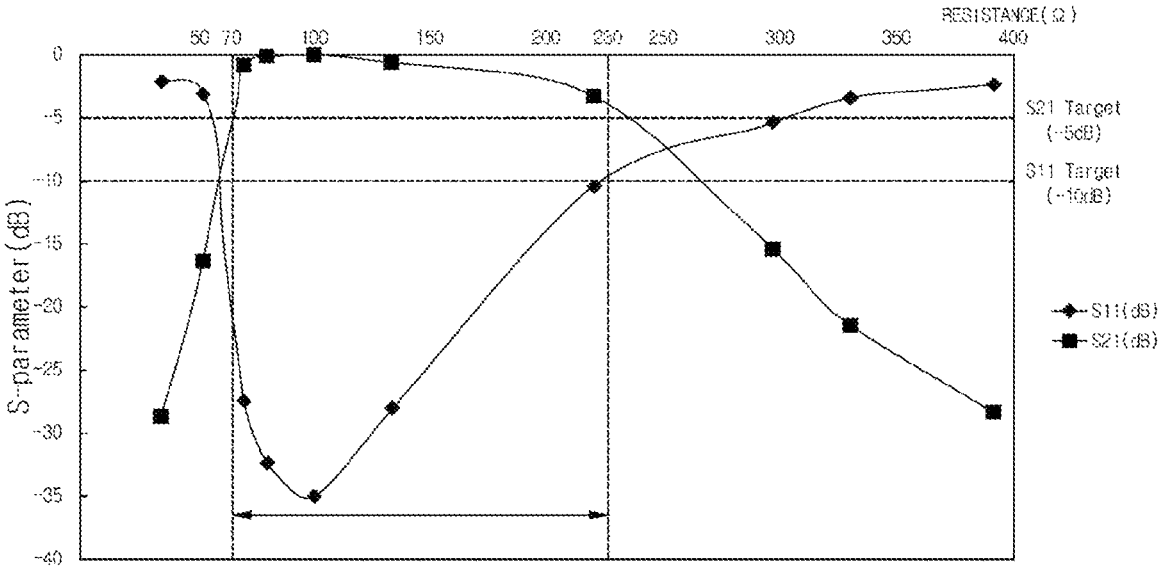
FIG. 6 is a graph illustrating S-parameters according to the resistance of a microstrip transmission line unit, in the embodiments of this invention.

Table 1 below shows the impedance, and the experimental values for the reflection coefficient S11 and the transmission coefficient S21, which are the main performance indicators of the antenna among the S-parameters, according to the resistance of the microstrip transmission line unit 20, and FIG. 6 is a view illustrating Table 1 as a graph.

TABLE 1

| Classification | Resistance of microstrip transmission line unit (Ω) | Impedance (Ω) | S11 (dB) | S21 (dB) |
|---|---|---|---|---|
| Comparative Example 1 | 391.44 | 91.5 | −2.32 | −28.32 |
| Comparative Example 2 | 330.125 | 80 | −3.41 | −21.48 |
| Comparative Example 3 | 296.81 | 70 | −5.34 | −15.43 |
| Example 1 | 220.405 | 65.0 | −10.38 | −3.24 |
| Example 2 | 134.0 | 60.9 | −28.08 | −0.63 |
| Example 3 | 100.62 | 52.6 | −35 | −0.08 |
| Example 4 | 80.6 | 46.5 | −32.3 | −0.16 |
| Example 5 | 70.38 | 40 | −27.42 | −0.81 |
| Comparative Example 4 | 53.03 | 30 | −3.08 | −16.38 |
| Comparative Example 5 | 35.02 | 20 | −2.12 | −28.68 |

Referring to Table 1 and FIG. 6, in Example 1, when the resistance of the microstrip transmission line unit 20 was 220.405Ω, the impedance was 65.0Ω, and the reflection coefficient S11 and the transmission coefficient S21 were measured as −10.38 and −3.24, respectively.

Further, in Example 2, when the resistance of the microstrip transmission line unit 20 was 134.0Ω, the impedance was 60.9Ω, and the reflection coefficient S11 and the transmission coefficient S21 were measured as −28.08 and −0.63, respectively.

Further, in Example 3, when the resistance of the microstrip transmission line unit 20 was 100.62Ω, the impedance was 52.6Ω, and the reflection coefficient S11 and the transmission coefficient S21 were measured as −35 and −0.08, respectively.

Further, in Example 4, when the resistance of the microstrip transmission line unit 20 was 80.6Ω, the impedance was 46.5Ω, and the reflection coefficient S11 and the transmission coefficient S21 were measured as −32.3 and −0.16, respectively.

Further, in Example 5, when the resistance of the microstrip transmission line unit 20 was 70.38Ω, the impedance was 40Ω, and the reflection coefficient S11 and the transmission coefficient S21 were measured as −27.42 and −0.81, respectively.

Considering these experiment results, it may be confirmed that the reflection coefficient S11 is −10 dB or less and the transmission coefficient S21 is −5 dB or more when the resistance of the microstrip transmission line unit 20 is 70Ω or more and 230Ω or less.

For example, the length of the microstrip transmission line unit 20 may satisfy Equation 1 below in order for the radiating patch unit 30 to radiate and receive signals according to resonance.

$$L=\lambda/2 \quad \text{[Equation 1]}$$

wherein L is a length of the microstrip transmission line unit, and λ is a wavelength of the signal.

The radiating patch unit 30 is formed on one surface of the base film 10 so as to be electrically connected to the microstrip transmission line unit 20, so that the signal fed through the microstrip transmission line unit 20 is radiated through the radiating patch unit 30, or an external signal is received through the radiating patch unit 30 and transmitted through the microstrip transmission line unit.

The ground unit 40 is formed on the other surface of the base film 10 and performs a function of a signal ground. The signal fed through the microstrip transmission line unit 20 is transmitted between the radiating patch unit 30 and the ground unit 40.

For example, at least one of the microstrip transmission line unit 20, the radiating patch unit 30, and the ground unit 40 may include at least one of copper (Cu), aluminum (Al), silver (Ag), nickel (Ni), chromium (Cr), cobalt (Co), molybdenum (Mo), titanium (Ti), palladium (Pd), or alloys thereof.

For example, at least one of the microstrip transmission line unit 20, the radiating patch unit 30, and the ground unit 40 may be configured to have a mesh structure.

For example, at least one of the microstrip transmission line unit 20, the radiating patch unit 30, and the ground unit 40 may be configured to have a single-layer or multi-layer structure.

For example, the film-type microstrip patch antenna according to the first embodiment of this invention may be configured such that a plurality of unit antennas each including the base film 10, the microstrip transmission line unit 20, the radiating patch unit 30, and the ground unit 40 are arranged.

Figure 5:
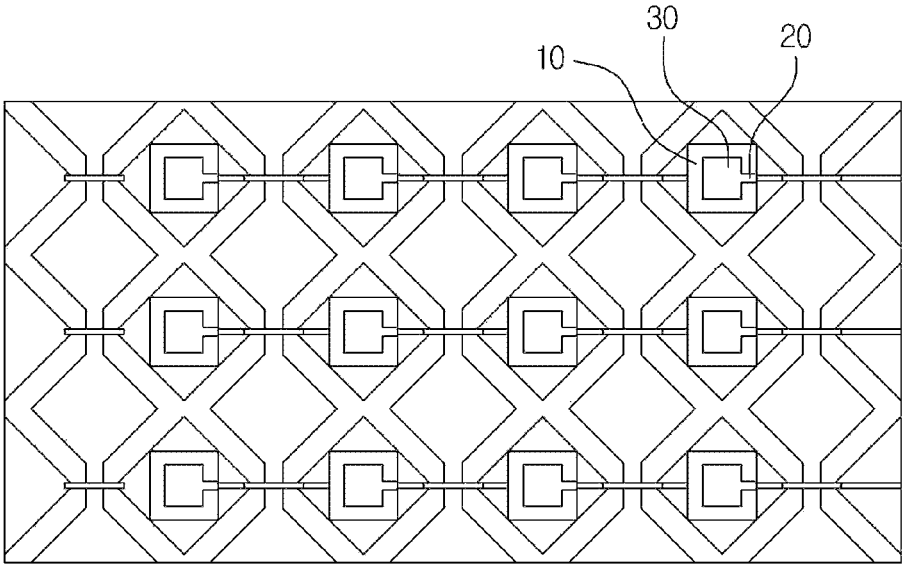
FIG. 5 is a diagram exemplarily illustrating an arrangement structure in which a plurality of unit antennas are arranged, in the embodiments of this invention.

FIG. 5 exemplarily illustrates an arrangement structure in which the plurality of unit antennas are arranged.

FIG. 5 exemplifies a case in which the plurality of unit antennas constituting the film-type microstrip patch antenna according to the embodiment of this invention are mounted on unit sensing cells of a touch sensor, but the mounting structure is not limited thereto.

As described above, when the plurality of unit antennas are arranged to implement an array patch antenna, the directivity of a radiated signal may be improved.

Figure 3:
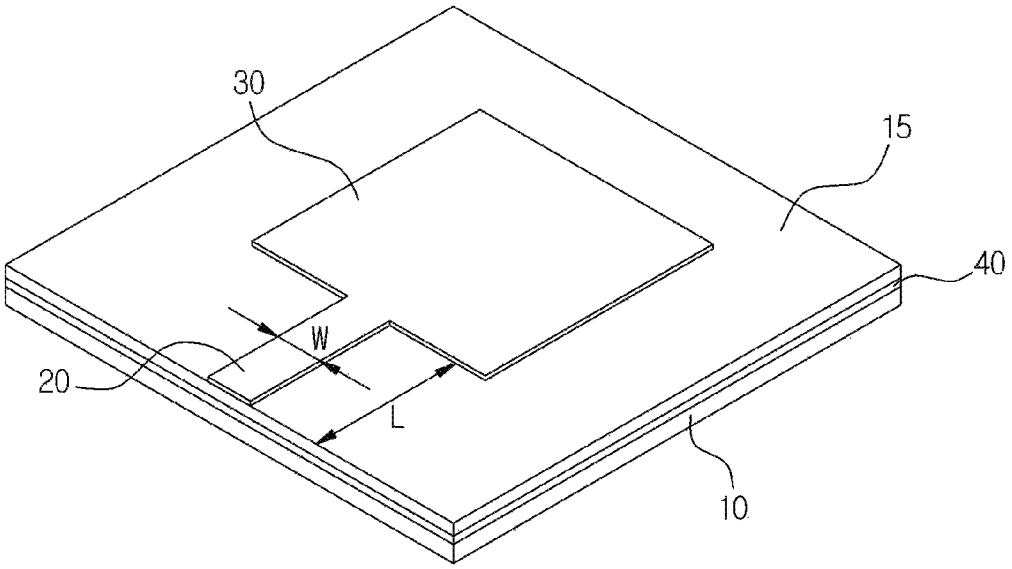
FIG. 3 is a perspective view of a film-type microstrip patch antenna according to a second embodiment of this invention.
Figure 4:
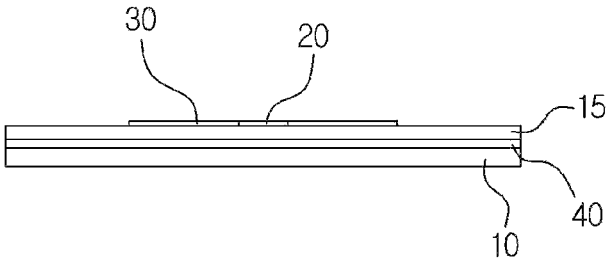
FIG. 4 is a cross-sectional view of the film-type microstrip patch antenna according to the second embodiment of this invention.

FIG. 3 is a perspective view of a film-type microstrip patch antenna according to a second embodiment of this invention, and FIG. 4 is a cross-sectional view of the film-type microstrip patch antenna according to the second embodiment of this invention.

Referring to FIGS. 3 and 4, the film-type microstrip patch antenna according to the second embodiment of this invention includes a base film 10, a ground unit 40 formed on the base film 10, an Insulating layer 15 formed on the ground unit 40, a microstrip transmission line unit 20 formed on the Insulating layer 15, and a radiating patch unit 30 formed on the Insulating layer 15 so as to be electrically connected to the microstrip transmission line unit 20.

The difference between the first embodiment and the second embodiment of this invention is that the second embodiment further includes the Insulating layer 15, and thus a lamination structure is somewhat different. Except for this, the description of the first embodiment may be applied to the second embodiment in substantially the same manner, and thus a duplicate description will be omitted.

As described above, according to this invention, there is an effect that a film-type microstrip patch antenna may be implemented in a screen display area of a display device by preventing components of the antenna from being unnecessarily visible to the user.

In addition, there is an effect that a film-type microstrip patch antenna may secure stable performance in a high-frequency environment such as 5G, in which a signal loss in the microstrip transmission line is great, through precise impedance matching.

In addition, there is an effect that a film-type microstrip patch antenna may be implemented in a screen display area of a display device and applied for a high-frequency band for 3G to 5G mobile communication.

DESCRIPTION OF REFERENCE NUMERALS

10: base film
15: Insulating layer
20: microstrip transmission line unit
30: radiating patch unit
40: ground unit

What is claimed is:

1. A film-type microstrip patch antenna that is formed in a screen region of a display device and can be applied to high-frequency bands for 3G to 5G mobile communication comprising:

a base film;

a microstrip transmission line unit formed on one surface of the base film;

a radiating patch unit formed on the one surface of the base film to be electrically connected to the microstrip transmission line unit; and a ground unit formed on the other surface of the base film, wherein the base film is a transparent optical film having a dielectric constant of 8 or less, wherein a resistance of the microstrip transmission line unit is 70Ω or more and 230Ω or less, wherein the radiating patch unit has a mesh structure, wherein at least one of the microstrip transmission line unit and the ground unit has a single-layer structure or multi-layer structure or a mesh structure.

2. The film-type microstrip patch antenna of claim 1, wherein a length of the microstrip transmission line unit satisfies Equation 1 below $$L=\lambda/2 \quad \text{[Equation 1]}$$

where L is the length of the microstrip transmission line unit, and λ, is a wavelength of a signal.

3. The film-type microstrip patch antenna of claim 1, wherein a reflection coefficient S11 is −10 dB or less.

4. The film-type microstrip patch antenna of claim 1, wherein a transmission coefficient S21 is −5 dB or more.

5. The film-type microstrip patch antenna of claim 1, wherein at least one of the microstrip transmission line unit, the radiating patch unit, and the ground unit includes one or more of copper (Cu), aluminum (Al), silver (Ag), nickel (Ni), chromium (Cr), cobalt (Co), molybdenum (Mo), titanium (Ti), palladium (Pd), or alloys thereof.

6. The film-type microstrip patch antenna of claim 1, wherein a plurality of unit antennas each including the base film, the microstrip transmission line unit, the radiating patch unit, and the ground unit are arranged.

7. A film-type microstrip patch antenna that is formed in a screen region of a display device and can be applied to high-frequency bands for 3G to 5G mobile communication comprising:

a base film;

a ground unit formed on the base film;

an Insulating layer formed on the ground unit;

a microstrip transmission line unit formed on the Insulating layer; and a radiating patch unit formed on the Insulating layer to be electrically connected to the microstrip transmission line unit, wherein the base film is a transparent optical film having a dielectric constant of 8 or less, wherein a resistance of the microstrip transmission line unit is 70Ω or more and 230Ω or less, wherein the radiating patch unit has a mesh structure, wherein at least one of the microstrip transmission line unit and the ground unit has a single-layer structure or multi-layer structure or a mesh structure.

8. The film-type microstrip patch antenna of claim 7, wherein a length of the microstrip transmission line unit satisfies Equation 1 below $$L=\lambda/2 \quad \text{[Equation 1]}$$

where L is the length of the microstrip transmission line unit, and λ is a wavelength of a signal.

9. The film-type microstrip patch antenna of claim 7, wherein a reflection coefficient S11 is −10 dB or less.

10. The film-type microstrip patch antenna of claim 7, wherein a transmission coefficient S21 is −5 dB or more.

11. The film-type microstrip patch antenna of claim 7, wherein at least one of the microstrip transmission line unit, the radiating patch unit, and the ground unit includes one or more of copper (Cu), aluminum (Al), silver (Ag), nickel (Ni), chromium (Cr), cobalt (Co), molybdenum (Mo), titanium (Ti), palladium (Pd), or alloys thereof.

12. The film-type microstrip patch antenna of claim 7, wherein a plurality of unit antennas each including the base film, the Insulating layer, the microstrip transmission line unit, the radiating patch unit, and the ground unit are arranged.

* * * * *